United States Patent [19]

Plaskett

[11] Patent Number: 4,627,217

[45] Date of Patent: Dec. 9, 1986

[54] APPARATUS FOR AUTOMATICALLY CLOSING L-SLIDE LOCK CASES

[75] Inventor: John Plaskett, Dallas, Tex.

[73] Assignee: Frito-Lay, Inc., Dallas, Tex.

[21] Appl. No.: 767,595

[22] Filed: Aug. 20, 1985

[51] Int. Cl.[4] ..... B65B 7/24

[52] U.S. Cl. ..... 53/374; 493/139

[58] Field of Search ..... 53/374, 377, 376; 493/139, 137, 136

[56] References Cited

U.S. PATENT DOCUMENTS

| | | | |
|---|---|---|---|
| 1,379,276 | 5/1921 | Moore . | |
| 1,615,631 | 1/1927 | Kimball et al. . | |
| 2,202,213 | 5/1940 | Lindholm . | |
| 2,206,761 | 7/1940 | Bergstein . | |
| 2,261,767 | 11/1941 | Johnson | 226/14 |
| 2,270,264 | 1/1942 | Carruth | 93/6 |
| 2,277,289 | 3/1942 | Bergstein et al. | 93/44 |
| 2,340,835 | 2/1944 | Malhiot . | |
| 2,380,758 | 7/1945 | Hohl . | |
| 2,660,012 | 11/1953 | Boyce et al. | 53/376 |
| 2,685,768 | 8/1954 | Mobley | 53/44 |
| 2,821,827 | 2/1958 | Shaw et al. | 53/124 |
| 2,836,946 | 6/1958 | Schroeder | 53/186 |
| 2,844,930 | 7/1958 | Nelson | 53/376 |
| 2,877,610 | 3/1959 | Atkinson | 53/38 |
| 3,002,432 | 10/1961 | Wendshuh | 493/263 |
| 3,032,947 | 5/1962 | Voller | 53/76 |
| 3,456,426 | 7/1969 | Fahey | 53/376 |
| 3,505,774 | 4/1970 | Gidge | 53/14 |
| 3,552,094 | 1/1971 | Daily et al. | 53/376 |
| 3,557,527 | 1/1971 | Wilkins | 53/374 |
| 3,584,434 | 6/1971 | Ellis | 53/374 X |
| 3,726,061 | 5/1973 | Pagdin et al. | 53/167 |
| 3,762,129 | 10/1973 | Salomon | 53/186 |
| 3,933,301 | 1/1976 | Pugsley | 229/41 B |
| 3,959,950 | 6/1976 | Fukuda | 53/37 |
| 3,960,313 | 6/1976 | Sax et al. | 239/41 |
| 3,973,375 | 8/1976 | Loveland | 53/374 |
| 4,007,869 | 2/1977 | Stolkin et al. | 229/41 |
| 4,040,560 | 8/1977 | Grossman et al. | 229/41 B |
| 4,079,577 | 3/1978 | Ulrich et al. | 53/374 |
| 4,196,563 | 4/1980 | Gabrielson et al. | 53/456 |
| 4,218,862 | 8/1980 | Marchetti | 53/374 |
| 4,251,978 | 2/1981 | Beck | 53/491 |
| 4,441,303 | 4/1984 | Langen | 53/374 |

*Primary Examiner*—James E. Coan

*Attorney, Agent, or Firm*—Bernard, Rothwell & Brown

[57] ABSTRACT

An apparatus for automatically closing L-slide lock cases moving in the direction of their longitudinal axis utilizes conveyor drive of the case and multiple guides that force and manipulate a closing flap by bending the closing flap and forcing free ends of the closing flap into the L-slide lock slots.

16 Claims, 4 Drawing Figures

APPARATUS FOR AUTOMATICALLY CLOSING L-SLIDE LOCK CASES

BACKGROUND OF THE INVENTION

1. Field of the Invention

This invention relates to improvements in apparatus for closing cases or cartons, and more particularly relates to an apparatus for automatically closing a top flap of an L-slide lock case.

2. Description of Background Art

The art of closing corrugated cardboard cases or cartons is old and well worked. It is known, for example, to move such cartons on a conveyor past stationary cams or the like for various operations of sealing and folding flaps. See, for example, U.S. Pat. Nos. 2,277,289, 2,261,767, 2,270,264.

Cartons having L-slide locks are commercially available from Stone Container Corp. and are widely used in the industry. Such cartons or cases are used by Frito-Lay, Inc. (the assignee of this application) to package bags of snack foods such as potato chips, corn chips, and the like, for shipment. The L-slide locks on the cartons make them easy to close by just inserting the opposite ends of an upstanding flap into the lock slots. L-slide lock cases are advantageous for shipment of snack food bags and the like because they are re-usable and can be closed without the use of glue, staples, tape, or other destructive closure means. When the cases are emptied, they are collapsible as set forth in U.S. Pat. Nos. 3,960,313 and 4,007,869, for ease in shipment back to the factory to be refilled. Prior to the present invention, the L-slide lock cases were manually closed after the bags of product were packed into the case. The obvious drawbacks to manual closing are that it is a labor-intensive, time-consuming and hence extremely expensive.

There is need in the art for an automatic case closing apparatus for L-slide lock cartons. This need has existed for some time until the present invention.

SUMMARY OF THIS INVENTION

This invention provides for automatically closing L-slide lock cases by moving each case with its longitudinal axis in the direction of travel on a conveyor while accurately guiding the cases beneath a set of flap guides. The conveyor drives each case such that an upstanding open flap is forced through the set of guides that fold and manipulate the flap into the L-shaped slot. More particularly, there is a stationary flap-fold position guide member which extends horizontally above the conveyor surface at a position above the top of the case, but below the outer edge of the open flap to define a desired bending line, the closing flap being scored by the manufacturer at the desired bending line. There is a stationary fold-forcing position guide rod having an inclined portion and a portion parallel to the conveyor surface, the inclined portion extending from a position outside the surface of the open flap and extending downwardly and inwardly to cross the stationary flap-fold guide rod and to fold the top flap about the stationary guide rod and move the edges of the top flap inwardly during movement of the case on the conveyor. There is further a plate member inclined in the direction of travel of the case following the guide rods and extending to the top surface of the case so that the edges of the flap as folded are tucked into the L-shaped slots and the natural resilience of the flap causes the previously folded flap to straighten out and function to close the case.

BRIEF DECRIPTION OF THE DRAWING

DETAILED DESCRIPTION OF THE PREFERRED EMBODIMENTS

Figure 1:
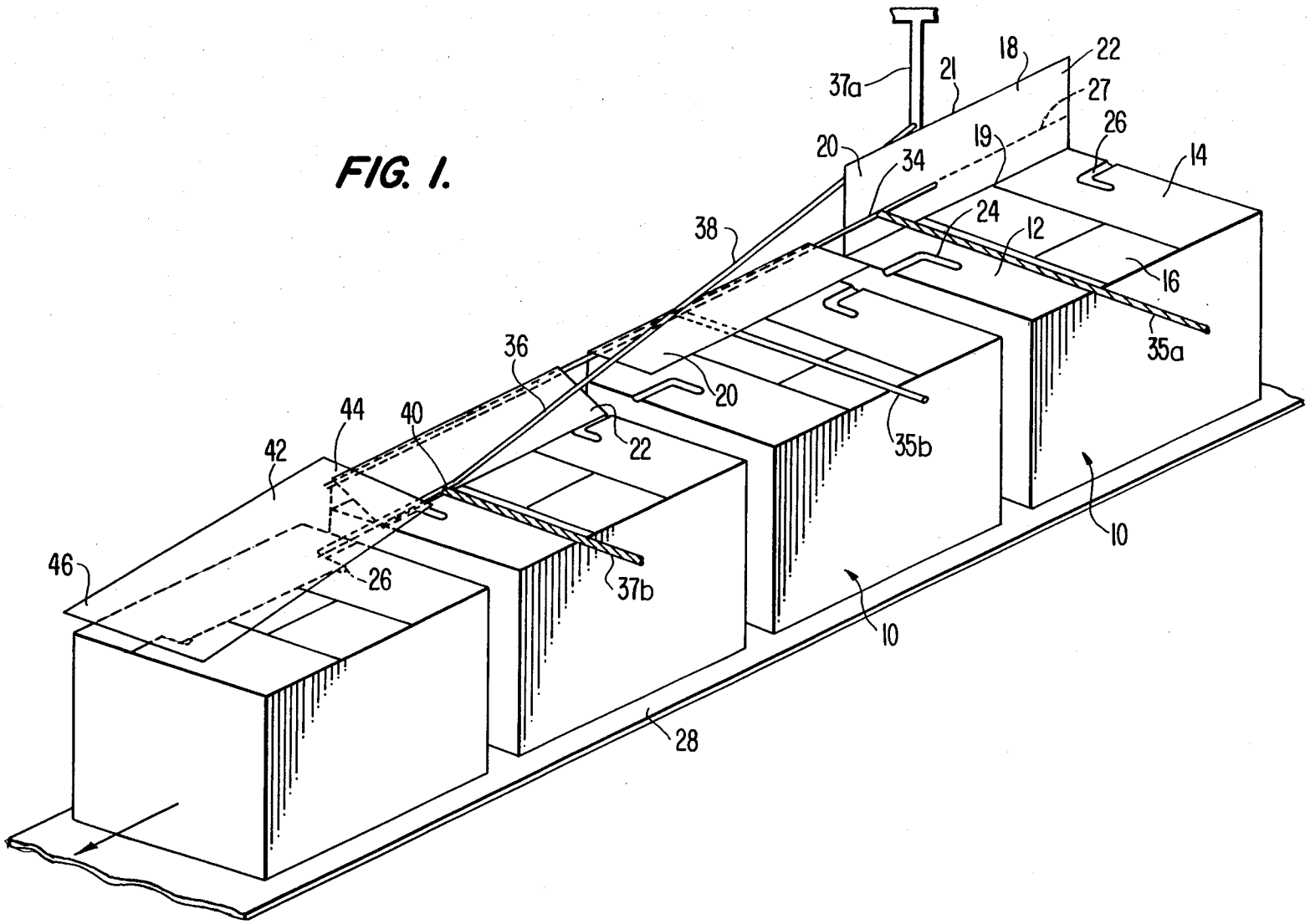
FIG. 1 is a perspective view schematically illustrating the case closing apparatus of this invention.

With reference to FIG. 1 there is shown a relatively large case or carton 10 made of corrugated cardboard and of a type that is desired to be closed. The case 10 is longer than it is wide and has been previously packed with bags of the product or the like. The case has a top portion including a pair of top panels or flaps 12 and 14 extending transverse to the minor axis which have been folded down on top of top panel 16. The other top panel or closing flap 18 is the last panel to be folded, and is open and upstanding. Flap 18 includes opposite free end corners 20 and 22 which are insertable into L-shaped slots 24 and 26 in panels 12 and 14 respectively. The flap 18 is foldable about a fold line 19 and has an outer free longitudinal edge 21.

Figure 3:
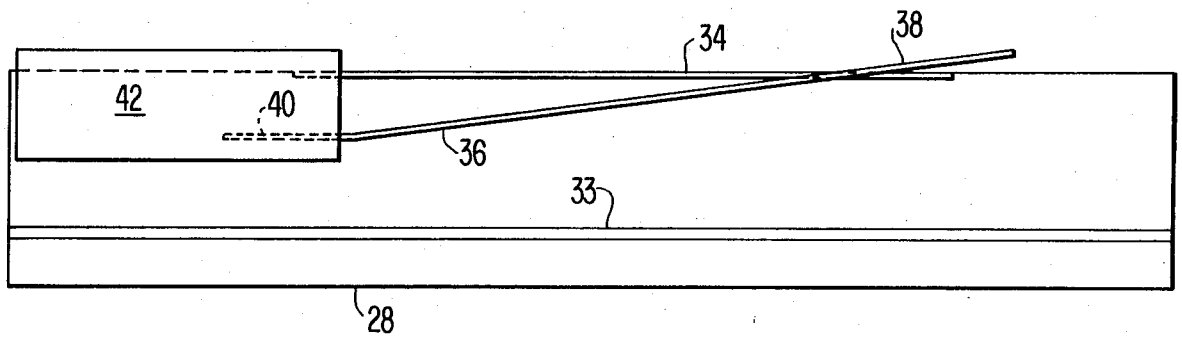
FIG. 3 is a top plan view of the case closing apparatus of this invention.
Figure 2:
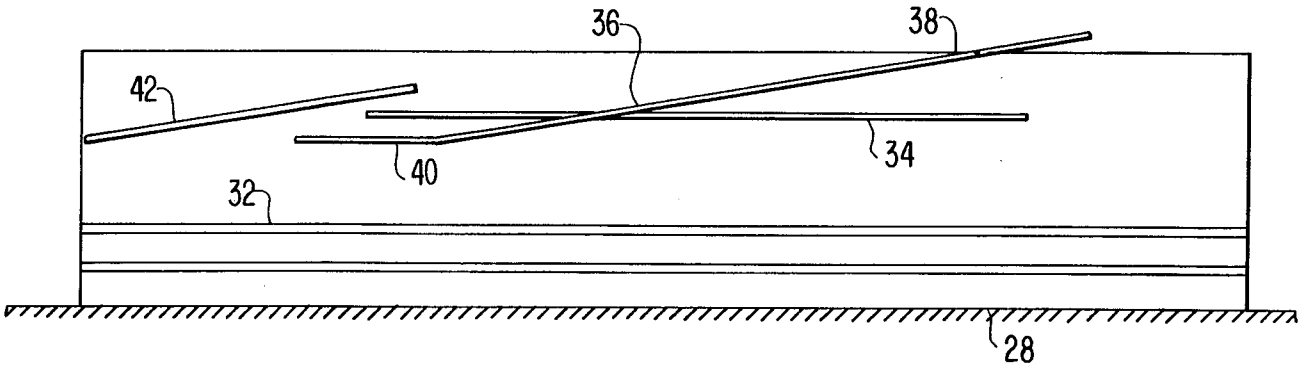
FIG. 2 is a side elevation view of the case closing apparatus of this invention
Figure 4:
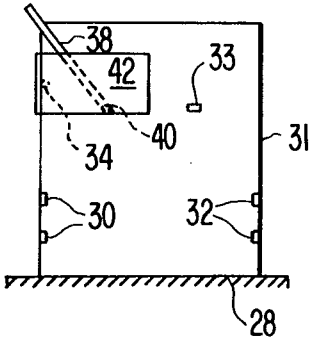
FIG. 4 is an end elevation view of the case closing apparatus of this invention.

A plurality of the cases 10 are spaced apart a slight distance and are driven by a conveyor surface 28, see FIGS. 2 and 4. The conveyor may be of any known type used to move cases. While travelling on the conveyor surface 28 the cases 10 are positively guided by side guides 30 and 32 extending from opposite sides of a housing 31. A top case guide 33 guides and holds the top of the case down on the conveyor. All of these guides extend the length of the apparatus as shown in FIGS. 3 and 4.

For folding and tucking ends 20 and 22 of flap 18 into L-shaped slots 24 and 26 to close the case there are provided closing flap bending means for bending the closing flap along bend (score) line 27 while the case is moving along its longitudinal axis and in the direction of the arrow in FIG. 1. There is also provided closing flap tucking means for holding the edge of the closing flap at a level with the top of the case and allowing the resiliency of the closing flap to cause each end to enter the L-shaped slots during movement of the case by the conveyor surface. More particularly, a stationary flap-bend position guide edge or rod 34 extends generally parallel to the conveyor surface at a position above the top of the case but substantially below the free longitudinal edge of the closing flap 18, the position of guide rod 34 corresponding to bend line 27. Rod 34 is supported by support rods 35*a* and 35*b* which are connected to external means of support (not shown). The position of the flap-bend position guide rod 34 is such that it is slightly inside vertically positioned flap 18, that is, toward the center of the carton from the flap as shown in the drawings and at a distance above the fold line 19 of the flap to position a desired bend in flap 18 as the case moves along.

Cooperating with the flap-bend position guide rod 34 during movement of the cases is a stationary bend-forcing guide edge or rod 36. The bend-forcing guide rod 36 includes an inclined portion 38. Rod 36 is supported by support rods 37*a* and 37*b* which are connected to external means of support (not shown). As shown in FIGS. 1 and 3, the inclined portion 38 of rod 36 starts from behind the flap 18 and above the stationary flap-bend position guide rod 34, and extends both inwardly and downwardly with respect to the surface of the conveyor to cross over the flap-bend position guide rod 34 when viewed both horizontally and vertically as shown in the drawings. With this arrangement and as shown in FIG. 1, as the case 10 moves in the direction of the arrow in FIG. 1, flap 18 is forced between rods 34 and 36 to bend flap 18 along bend line 27, thereby bending the closing flap to form a longitudinal bend in the closing flap which is parallel with the direction of movement of the case, and thereby moving the outer edge 21 of flap 18 downwardly to a level with the top of the 10 cases so that ends 20 and 22 of flap 18 are positioned adjacent respective L-slots 24 and 26.

Guide rod 36 also includes horizontal portion 40 which is parallel to the surface of the conveyor at a level equal to the top surface of the case 10. This portion 40 holds the longitudinal outer edge 21 of the flap 18 at about a level with the top of the case and in position for tucking flap ends 20 and 22 into respective L-slots 24 and 26.

To further complete and to assure that the ends 20 and 22 of flap 18 are tucked into the L-shaped slots 24 and 26, there is provided a flap-tucking guide member 42 in the form of a planar surface (e.g., plate member) which is inclined downwardly relative to the surface of the conveyor with its uppermost end 44 positioned over the end of rods 34 and 36 as shown in FIG. 2 and with its lower-most end 46 positioned at the level of the top of the carton. As case 10 moves in the direction of the arrow in FIG. 1, plate member 42 acts on the bend along bend line 27 of closing flap 18 to force and guide the bend towards the level of the top of the case and thereby force flap ends 20 and 22 into respective L-slots 24 and 26, thereby closing the case as shown for the case at the left-hand side of FIG. 1.

Guide rod portion 40 and plate member 42 thereby provide means for tucking the opposite free end corners of the closing flap into respective L-slots in the top of the case.

It will be appreciated that guides 34 and 36 need not be rods, and that guide member 42 need not be a plate, but can be any suitable means for accomplishing their respective functions, such as rollers, edges or surfaces.

The invention is applicable to different sized cartons. The positions of the guides may be adjustable for different sizes, e.g., heights, of the cases to be closed.

It can be seen that there is disclosed a simple and unique apparatus for automatically closing L-slide lock cartons as the cartons pass through a set of guides which bend the flap of a carton and tuck the corners of the flap into the L- slide locks, the carton travelling with its longitudinal axis extending in the direction of travel.

Since many modifications, variations and changes in detail may be made to the described embodiment, it is intended that all matter in the foregoing description and shown in the accompanying drawings be interpreted as illustrative and not in a limiting sense.

I claim:

1. Apparatus for automatically closing the top of a case having a closing flap and L-slide lock slots for receiving opposite free end corners of the closing flap while the case is moving with its longitudinal axis in the direction of movement, the apparatus comprising:

(a) a conveyor for moving a case, the case having a top portion which includes an open closing flap having a free longitudinal edge and opposite free end corners, the top portion further including L-slide lock slots for receiving respective free end corners of the closing flap;

(b) means for guiding the case to accurately position the case on the conveyor during movement of the conveyor with the longitudinal axis of the case in the direction of movement of the case;

(c) means for bending the closing flap to form a longitudinal bend in the closing flap while the case is moving on the conveyor so that the free longitudinal edge of the closing flap is positioned at about a level with the top of the case and the opposite free corners of the closing flap are positioned adjacent respective L-slide lock slots, the longitudinal bend being generally parallel with the direction of movement of the case;

(d) means for tucking the opposite free end corners of the closing flap into the respective L-shaped slots during movement of the case by the conveyor, the closing flap tucking means including means for holding the longitudinal edge of the closing flap at about a level with the top of the case, the closing flap tucking means further including means for guiding the longitudinal bend of the closing flap to a position at about a level with the top of the case, while the case is moving on the conveyor, to cause each of said free end corners to enter the respective L-shaped slots and thereby close the top of the case.

2. Apparatus as in claim 1 wherein the closing flap bending means comprises:

(a) a stationary, flap-bend position guide edge extending generally parallel to the conveyor and above the conveyor surface at a position above the top of the case but substantially below the free longitudinal edge of the closing flap and positioned slightly inside the surface of the closing flap when the closing flap is positioned vertically;

(b) a stationary bend-forcing guide edge including an inclined portion extending from a position outside the surface of the closing flap when standing vertically, the bend-forcing guide edge extending downwardly and inwardly to cross over the bend position guide edge when viewed either horizontally or vertically to a position inwardly and below the flap-bend position guide edge.

3. Apparatus as in claim 2 wherein the bend position guide edge and the bend-forcing guide edge each comprise individual stationary rods.

4. Apparatus as in claim 1 wherein the means for guiding the longitudinal bend of the closing flap comprises a generally planar surface.

5. Apparatus as in claim 2 wherein the means for guiding the longitudinal bend of the closing flap comprises a generally planar surface.

6. Apparatus as in claim 3 wherein the means for guiding the longitudinal bend of the closing flap comprises a generally planar surface.

7. Apparatus in claim 1 wherein the means for guiding the longitudinal bend of the closing flap comprises a plate member.

8. Apparatus in claim 2 wherein the means for guiding the longitudinal bend of the closing flap comprises a plate member.

9. Apparatus in claim 3 wherein the means for guiding the longitudinal bend of the closing flap comprises a plate member 10. Apparatus as in claim 4 wherein the longitudinal edge-holding means comprises a horizontal edge extending from the inclined portion of the bend-forcing guide edge to a position under an uppermost end of said planar surface 11. Apparatus as in claim 5 wherein the longitudinal edge-holding means comprises a horizontal edge extending from the inclined portion of the bend-forcing guide edge to a position under an uppermost end of said planar surface 12. Apparatus as in claim 6 wherein the longitudinal edge-holding means comprises a horizontal edge extending from the inclined portion of the bend-forcing guide edge to a position under an uppermost end of said planar surface 13. Apparatus as in claim 7 wherein the longitudinal edge-holding means comprises a horizontal edge extending from the inclined portion of the bend-forcing guide edge to a position under an uppermost end of said plate member.

14. Apparatus as in claim 8 wherein the longitudinal edge-holding means comprises a horizontal edge extending from the inclined portion of the bend-forcing guide edge to a position under an uppermost end of said plate member 15. Apparatus as in claim 9 wherein the longitudinal edge-holding means comprises a horizontal edge extending from the inclined portion of the bend-forcing guide edge to a position under an uppermost end of said plate member.

16. Apparatus for automatically closing the top of a case having a closing flap and L-slide lock slots for receiving opposite free end corners of the closing flap while the case is moving with its longitudinal axis in the direction of movement, the apparatus comprising:

(a) a conveyor for moving a case, the case having a top portion which includes an open closing flap having a free longitudinal edge and opposite free end corners, the top portion further including L-slide lock slots for receiving respective free end corners of the closing flap;

(b) means for guiding the case to accurately position the case on the conveyor during movement of the conveyor with the longitudinal axis of the case in the direction of movement of the case;

(c) means for bending the closing flap to form a longitudinal bend in the closing flap while the case is moving on the conveyor so that the free longitudinal edge of the closing flap is positioned at about a level with the top of the case and the opposite free corners of the closing flap are positioned adjacent respective L-slide lock slots, the longitudinal bend being generally parallel with the direction of movement of the case; the closing flap bending means including a stationary, flap-bend position guide edge extending generally parallel to the conveyor and above the conveyor surface at a position above the top of the case but substantially below the free longitudinal edge of the closing flap and positioned slightly inside the surface of the closing flap when the closing flap is positioned vertically; and the closing flap closing means further including a stationary bend-forcing guide edge including an inclined portion extending from a position outside the surface of the closing flap when standing vertically, the bend-forcing guide edge extending downwardly and inwardly to cross over the bend position guide edge when viewed either horizontally or vertically to a position inwardly and below the flap-bend position guide edge;

(d) means for tucking the opposite free end corners of the closing flap into the respective L-shaped slots during movement of the case by the conveyor, the closing flap tucking means including means for holding the longitudinal edge of the closing flap at about a level with the top of the case, the closing flap tucking means further including means for guiding the longitudinal bend of the closing flap to a position at about a level with the top of the case, while the case is moving on the conveyor, to cause each of said free end corners to enter the respective L-shaped slots and thereby close the top of the case; the longitudinal edge-holding means comprising a horizontal edge extending from the inclined portion of the bend-forcing guide edge to a position under the longitudinal bend guiding means.

* * * * *